US009188314B2

(12) United States Patent
Wu et al.

(10) Patent No.: US 9,188,314 B2
(45) Date of Patent: Nov. 17, 2015

(54) LIGHT EMITTING DIODE DEVICE

(71) Applicant: DELTA ELECTRONICS, INC., Taoyuan Hsien (TW)

(72) Inventors: Hsiang-Chen Wu, Taoyuan Hsien (TW); Chih-Yuan Huang, Taoyuan Hsien (TW); Kun-Ming Tien, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 0 days.

(21) Appl. No.: 14/292,324

(22) Filed: May 30, 2014

(65) Prior Publication Data

US 2015/0159838 A1 Jun. 11, 2015

(30) Foreign Application Priority Data

Dec. 11, 2013 (TW) ..... 102223306 U

(51) Int. Cl.
*F21V 15/01* (2006.01)
*F21K 99/00* (2010.01)

(52) U.S. Cl.
CPC . *F21V 15/01* (2013.01); *F21K 9/50* (2013.01); *F21V 15/011* (2013.01)

(58) Field of Classification Search
CPC ..... H01L 33/44; H01L 33/60; F21V 5/04; F21V 5/007; F21V 5/046; G02B 5/1885; G02B 19/0029; G02B 19/0066; H05K 1/182; H05K 2201/10106; F21Y 2101/02; F21Y 2105/001; F21Y 2103/0003; F21K 9/00; G03B 21/2013; G11C 19/28
USPC ..... 362/182, 217.01, 217.02, 217.05, 362/217.1, 217.11, 217.14, 217.15, 2, 25, 362/227, 235–237, 240–245, 249.01, 362/249.02, 267, 326–328; 257/E25.02, 257/E33.066, E33.073, 88, 99–101, 257
See application file for complete search history.

(56) References Cited

U.S. PATENT DOCUMENTS

| | | | | |
|---|---|---|---|---|
| 7,938,558 | B2 * | 5/2011 | Wilcox et al. | 362/236 |
| 8,070,316 | B2 * | 12/2011 | Urano et al. | 362/249.02 |
| 8,101,434 | B2 * | 1/2012 | Guillien et al. | 438/15 |
| 8,702,241 | B2 * | 4/2014 | Ohsugi | 353/38 |
| 2006/0097291 | A1 * | 5/2006 | Takahashi et al. | 257/257 |
| 2009/0166655 | A1 | 7/2009 | Lin | |

FOREIGN PATENT DOCUMENTS

| | | |
|---|---|---|
| TW | 201209330 A | 3/2012 |
| TW | I368709 | 7/2012 |
| TW | M440387 U | 11/2012 |

* cited by examiner

*Primary Examiner* — Hargobind S Sawhney
(74) *Attorney, Agent, or Firm* — Muncy, Geissler, Olds & Lowe, P.C.

(57) ABSTRACT

A light emitting diode (LED) device is disclosed. The LED device includes a light emitting module, a metal barrier, an isolation structure, a metal housing and a plurality of lenses. The light emitting module has a plurality of light emitting diodes serving as light sources. The metal barrier is disposed above the light emitting module, and the light emitting diodes are exposed from the metal barrier. The isolation structure and the metal housing are disposed above the metal barrier. The lenses are disposed corresponding to the light emitting diodes. The lenses are directly fixed on the metal housing or located between the isolation structure and the metal housing.

9 Claims, 2 Drawing Sheets

LIGHT EMITTING DIODE DEVICE

CROSS REFERENCE TO RELATED APPLICATIONS

This Non-provisional application claims priority under 35 U.S.C. §119(a) on Patent Application No(s). 102223306 filed in Taiwan, Republic of China on Dec. 11, 2013, the entire contents of which are hereby incorporated by reference.

BACKGROUND OF THE INVENTION

1. Field of Invention

The present invention relates to an illumination device and, in particular, to a light emitting diode (LED) device.

2. Related Art

Typically, the conventional LED lamp includes an LED module and a power supply. In order to achieve better conversion efficiency, the series voltage of the LED module is usually adjusted to fit the voltage provided from the power supply so as to minimize the loss in the voltage-dropout conversion. For example, if the power supply is connected to the city electricity, the series voltage of the LED module is preferably adjusted to 220V. However, when the output voltage of the DC terminal of the power supply is larger than 60V (safety voltage), it will be determined as a high-voltage terminal. In order to protect the user from the electric shock caused by the high-voltage terminal, the Standard UL 1598 (UL Lighting Standard) requests the lamp with high voltage higher than the safety voltage to configure an additional safety barrier for isolating and protecting the high-voltage wires. This configuration can prevent the user from directly connecting the high-voltage wires. A conventional LED device configured with the safety barrier will be described hereinafter.

U.S. patent application Ser. No. 11/774,422 discloses an LED apparatus including a mounting board, a plurality of LED packages thereon, a lens member over each LED package, a safety barrier positioned over the mounting board, a resilient member having apertures for each of the lens members, and a cover.

To satisfy the Standard UL 1598, the conventional LED apparatus is configured with the safety barrier on the mounting board for covering the exposed circuits (metal wires) on the mounting board. Accordingly, the safety barrier may contain: (1) iron-contained or iron-free metal with a thickness of at least 0.016 inches; (2) glass or ceramics with a thickness of at least 0.118 inches; (3) glass fiber tube with a thickness of at least 0.010 inches; (4) vulcanized fiber with a thickness of at least 0.028 inches; or (5) polymers with a flame class of HB.

The light emitted from the LED packages is properly distributed through a light-transmission portion of the lens member. The resilient member covering the lens member is made of rubber, so that it can provide the functions of water-proof and dustproof and absorb the heat generated by the LED, which may cause the shift of the lens member.

However, the thickness of the resilient member can directly affect the distance between the lens member and the cover. In face, the thicker the resilient member is, the larger the distance between the lens member and the cover is. When the distance between the lens member and the cover becomes larger, more light beams will be trapped and blocked inside the LED apparatus. Accordingly, the thickness of the resilient member must be properly decreased to increase the light output.

Besides, if the cover is made of metal material, the minimization of the thickness of the resilient member has a critical limitation due to the arcing issue of the cover and the safety barrier.

Therefore, it is an important subject to provide an LED device that is thinner and has lower light loss and higher safety.

SUMMARY OF THE INVENTION

In view of the foregoing subject, an objective of the present invention is to provide an LED device that is thinner and has lower light loss and higher safety.

To achieve the above objective, a light emitting diode (LED) device of the present invention includes a light emitting module, a metal barrier, an isolation structure, a plurality of lenses and a metal housing. The light emitting module has a plurality of light emitting diodes serving as light sources. The metal barrier is disposed above the light emitting module, and the light emitting diodes are exposed from the metal barrier. The isolation structure and the metal housing are disposed above the metal barrier. The lenses are disposed corresponding to the light emitting diodes. The lenses are directly fixed on the metal housing or located between the isolation structure and the metal housing.

In one embodiment of the invention, the LED device further includes a first insulating layer disposed between the metal barrier and the plurality of lenses or between the metal barrier and the metal housing.

In one embodiment of the invention, the LED device further includes a reflecting layer disposed on the surface of the first insulating layer or the surfaces of the plurality of lenses.

In one embodiment of the invention, the light emitting module further has a circuit board and a second insulating layer. The light emitting diodes are disposed on the circuit board. The second insulating layer is disposed between the circuit board and the metal barrier, and the light emitting diodes are exposed from the second insulating layer.

In one embodiment of the invention, the isolation structure is made of plastic, glass or silica gel.

In one embodiment of the invention, the thickness of the first insulating layer is smaller than or equal to 0.7 mm.

In one embodiment of the invention, the metal housing is made of metal or high thermo-conductive material. The metal includes copper, aluminum, iron or magnesium alloy.

As mentioned above, the metal housing and the lenses are directly connected, so that the distance between the lenses and the metal housing is sufficiently minimized. This configuration can effectively reduce the light loss, thereby achieving the goal of thinner LED device with lower light loss and higher safety.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
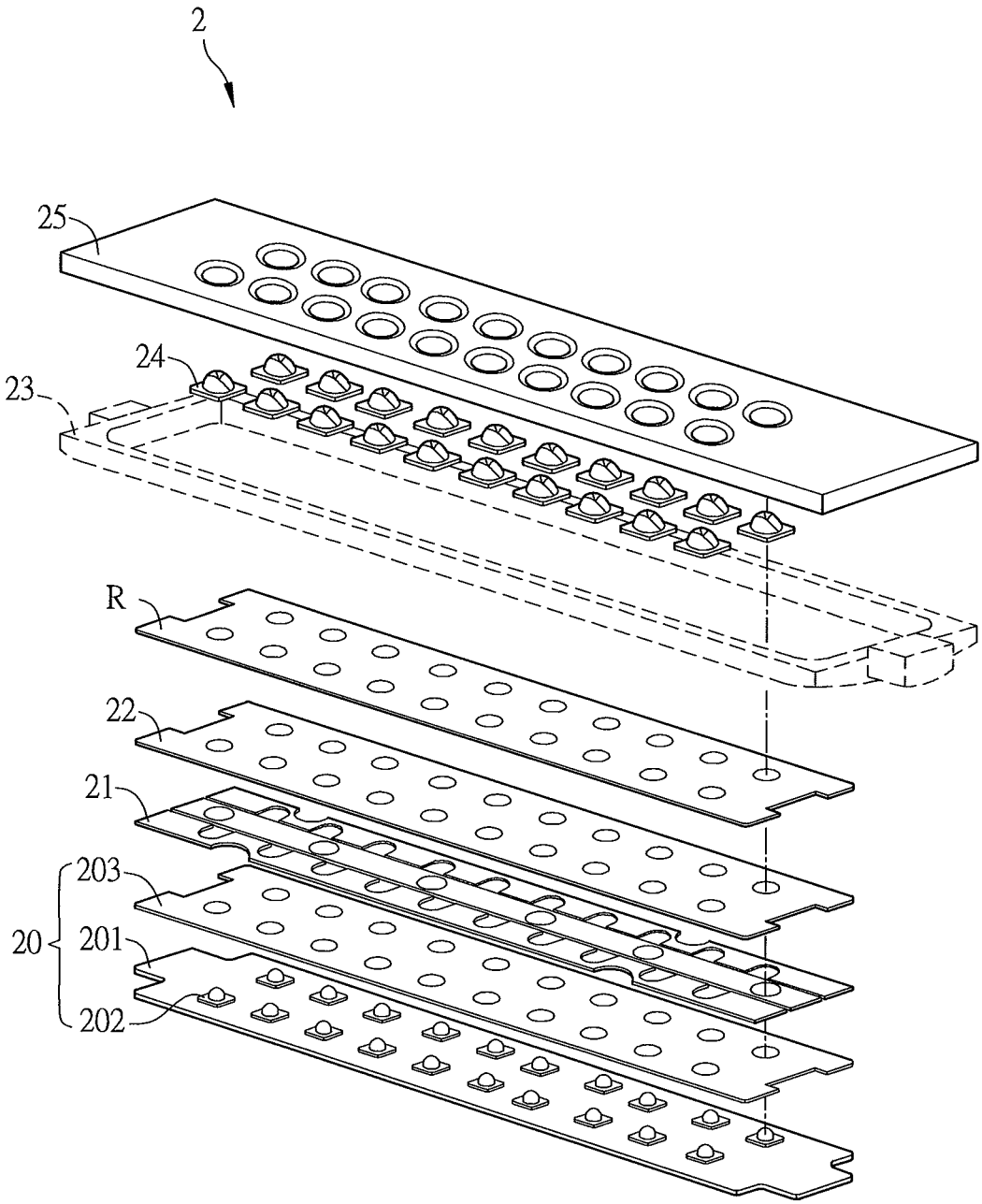
FIG. 1 is an exploded view of an LED device according to a preferred embodiment of the invention.
Figure 2:
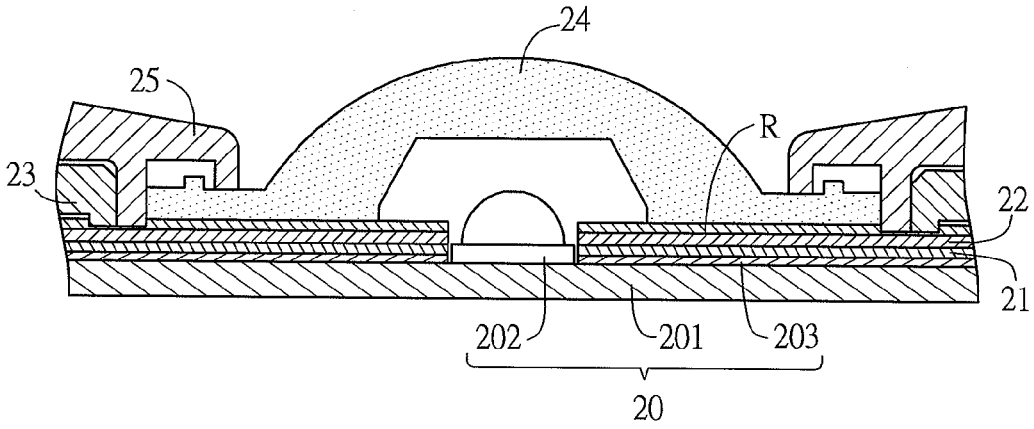
FIG. 2 is a partial enlarged sectional view of the LED device of FIG. 1.

FIG. 1 is an exploded view of an LED device 2 according to a preferred embodiment of the invention, and FIG. 2 is a partial enlarged sectional view of the LED device 2 of FIG. 1.

Referring to FIGS. 1 and 2, the LED device 2 includes a light emitting module 20, a metal barrier 21, a plurality of lenses 24, an isolation structure 23 and a metal housing 25. Besides, the LED device 2 may further include a first insulating layer 22.

The light emitting module 20 has a plurality of light emitting diodes 202 serving as light sources.

In addition, the LED device 2 may further have a waterproof function, so that it can be adapted to the outdoor applications such as the streetlamps or vehicle lamps. Preferably, the isolation structure 23 is disposed on the metal barrier 21. Moreover, when the LED device 2 is configured with a heat sink (not shown) or a metal housing 25, the plurality of lenses 24 are directly contact with the heat sink or the metal housing 25. In other words, the plurality of lenses 24 are located between the isolation structure 23 and the heat sink/metal housing 25 for occupying the gap between the heat sink/metal housing 25 and other components of the LED device 2. Accordingly, the lenses 24, the isolation structure 23 and the heat sink/metal housing 25 can together form an airtight water-proof space for accommodating the light emitting module 20, the metal barrier 21 and the first insulating layer 22.

The plurality of lenses 24 are disposed corresponding to the light emitting diodes 202, respectively, and the lenses 24 are directly fixed on the metal housing 25 or located between the isolation structure 23 and the metal housing 25. The light is emitted from the light emitting diode 202, passes through the opening of the metal barrier 21, and is then outputted through the lens 24. The configuration of the lenses 24 make the outputted light to be uniformly diverged. The plurality of lenses 24 can be integrally formed as one piece or be composed of multiple lens assemblies. Generally, the lenses 24 are made of light permeable materials such as, for example but not limited to, plastic (e.g. PC, PVC, PMMA, PET, PS and the likes), glass or silica gel.

The metal housing 25 is disposed above the metal barrier 21. In this embodiment, the metal housing 25 further includes a plurality of openings, and the plurality of lenses 24 can be exposed through the openings. The benefit of utilizing the metal housing 25 is to increase the rigidity of the LED device 2, so that the structure of the LED device 2 can be stronger and have higher resistance to impact and damage. The metal housing 25 can be made of metal or high thermo-conductive material. Herein, the metal may include copper, aluminum, iron or magnesium alloy.

Besides, the light emitting module 20 further includes a circuit board 201 and a second insulating layer 203.

In more detailed, the light emitting diodes 202 are disposed on the circuit board 201, so that they can be connected in series through the layout of the circuit board 201. Moreover, the circuit board 201 further includes two leads (not shown) configured at the same side of the circuit board 201. One ends of the leads are electrically connected to the light emitting diode 202, while the other ends of the leads are electrically connected to the power source (not shown).

The second insulating layer 203 is disposed between the circuit board 201 and the metal barrier 21 for isolating and protecting the high voltage of the circuit board 201. The second insulating layer 203 has a plurality of openings corresponding to the light emitting diodes 202, so that the light from the light emitting diodes 202 can be emitted out through the openings.

The metal barrier 21 is disposed on the light emitting module 20, and the light emitting diodes 202 are exposed from the metal barrier 21. In order to match the Standard UL 1598, the metal barrier 21 is made of a metal material with the thickness fitting the minimum UL requirement (over 0.41 mm). In one aspect, a distance is configured between the metal barrier 21 and the circuit board 201 for preventing the contact of the metal barrier 21 and the wires on the circuit board 201. In this embodiment, the second insulating layer 203 is positioned between the circuit board 201 and the metal barrier 21 so as to provide the desired distance therebetween. Besides, the second insulating layer 203 can be configured corresponding to the shape of the metal barrier 21 for properly isolating the metal barrier 21 and the wires of the circuit board 201. This configuration can avoid the undesired electrical contact therebetween as well as the issues of short circuit and damages.

In another aspect, an insulating layer is coated on a surface of the metal barrier 21 close to the circuit board instead of the above-mentioned second insulating layer 203. For example, the second insulating layer 203 can be a flexible insulating film attached on the metal barrier 21. This configuration can also provide the similar effect as the above aspect.

The metal barrier 21 may further include a thermal conductive plate (not shown) disposed at one side of the circuit board 201 opposite to the metal barrier 21. The thermal conductive plate is made of metal material with high thermal conductivity and is used for speeding the conduction and dissipation of the heat generated by the components and wires of the circuit board 201.

Referring to FIG. 1, the first insulating layer 22 is disposed between the metal barrier 21 and a plurality of lenses 24 or between the metal barrier 21 and the metal housing 25 for increasing the dielectric coefficient between the metal housing 25 and the metal barrier 21, thereby preventing the arcing caused by the short distance therebetween. In addition, the first insulating layer 22 further includes a plurality of openings for exposing the light emitting diodes 202.

The thickness of the first insulating layer 22 is at least smaller than 0.7 mm. In one aspect, the LED device of the invention further includes a reflecting layer R disposed between the first insulating layer and the lens module. In another aspect, a reflecting film is coated on the surfaces of the plurality of lenses or on the surface of the first insulating layer close to the lenses.

In brief, the light emitting module 20, the metal barrier 21, the first insulating layer 22, the plurality of lenses 24 and the metal housing 25 are stacked in sequence inside the LED device 2. In this embodiment, the light emitting module 20, the metal barrier 21, the first insulating layer 22 and the plurality of lenses 24 are connected by screws. However, this invention is not limited thereto. For example, the components inside the LED device 2 can also be connected by wedging, gluing or welding.

In specific, the material of the isolation structure 23 can be, for example, rubber, and it has a hollow ring shape. Thus, the isolation structure 23 can fill the gap between the heat sink or metal housing 25 and other components. Moreover, the outer edge of the isolation structure 23 is configured with a concave-convex structure for contacting against the heat sink or metal housing 25. The concave-convex structure allows a smaller friction during the assembling of the isolation structure 23. This configuration can facilitate the assembling procedure and further provide a better water-proof effect and an additional anti-vibration function.

In summary, the metal housing and the lenses are directly connected, so that the distance between the lenses and the metal housing is sufficiently minimized This configuration can effectively reduce the light loss, thereby achieving the goal of thinner LED device with lower light loss and higher safety.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A light emitting diode (LED) device, comprising:

a light emitting module having a plurality of light emitting diodes serving as light sources;

a metal barrier disposed above the light emitting module, wherein the light emitting diodes are exposed from the metal barrier;

an isolation structure disposed above the metal barrier;

a metal housing disposed above the metal barrier; and a plurality of lenses disposed corresponding to the light emitting diodes, wherein the lenses are directly fixed on the metal housing.

2. The LED device of claim 1, further comprising one of:

a first insulating layer disposed between the metal barrier and the plurality of lenses; and a first insulating layer disposed between the metal barrier and the metal housing.

3. The LED device of claim 2, wherein the thickness of the first insulating layer is less than or equal to 0.7 mm.

4. The LED device of claim 2, further comprising one of:

a reflecting layer disposed on the surface of the first insulating layer; and a reflecting layer disposed on the surfaces of the plurality of lenses.

5. The LED device of claim 1, wherein the light emitting module further has:

a circuit board, wherein the light emitting diodes are disposed on the circuit board; and a second insulating layer disposed between the circuit board and the metal barrier, wherein the light emitting diodes are exposed from the second insulating layer.

6. The LED device of claim 1, wherein the isolation structure is composed of one of: plastic, glass and silica gel.

7. The LED device of claim 1, wherein the metal housing is composed of one of: metal and high thermo-conductive material.

8. The LED device of claim 1, wherein a metal of the metal housing comprises one of: copper, aluminum, iron and magnesium alloy.

9. The LED device of claim 1, wherein the lenses are located between the isolation structure and the metal housing.

* * * * *